United States Patent [19]

Bonhomme

[11] 4,203,647

[45] May 20, 1980

[54] ELECTRIC SOCKETS FOR PLUG AND SOCKET CONNECTORS AND METHODS FOR THEIR MANUFACTURE

[76] Inventor: François R. Bonhomme, 6 Parc de Bearn, Saint-Cloud, France, 92210

[21] Appl. No.: 4,864

[22] Filed: Jan. 19, 1979

[30] Foreign Application Priority Data

Jan. 25, 1978 [FR] France ..... 78 01990

[51] Int. Cl.[2] ..... H01R 13/12

[52] U.S. Cl. ..... 339/256 R; 339/262 R

[58] Field of Search ..... 339/255 RT, 256 R, 256 S, 339/262

[56] References Cited

U.S. PATENT DOCUMENTS

| | | | |
|---|---|---|---|
| 1,833,145 | 11/1931 | Wilhelm | 339/256 R |
| 3,107,966 | 10/1963 | Bonhomme | 339/256 R |

*Primary Examiner*—Joseph H. McGlynn

*Attorney, Agent, or Firm*—Larson, Taylor and Hinds

[57] ABSTRACT

An electric socket for plug and socket connectors comprises resilient conducting wires. Each wire is stretched between two rigid rings and extends at rest along generatrices of one of the two families of generatrices of a hyperboloid of revolution. When a plug is inserted into the socket, it deforms the wires which are thus made to engage the plug each along a helical line. The two rings are rigidly fixed with respect to each other through metallic, relatively rigid distance-pieces, circumferentially spaced from each other. The distance-pieces are fixed symmetrically to the rings and are inclined in the same direction and by about the same angle as the adjacent resilient wires, with respect to the longitudinal axis of the socket.

3 Claims, 13 Drawing Figures

ELECTRIC SOCKETS FOR PLUG AND SOCKET CONNECTORS AND METHODS FOR THEIR MANUFACTURE

The present invention relates to electric sockets for plug and socket connectors of the type comprising a plurality of resilient conducting wires each of which is stretched between first and second points located respectively on first and second circles, which circles are located respectively on two relatively rigid rings rigidly fixed with respect to each other, so that a radius of the first circle passing through said first point on each wire and a radius of the second circle passing through said second point on the same wire make between themselves an angle of a fixed value different from zero, whereby straight lines along which the respective wires extend at rest (i.e. when not engaged by a plug) may be obtained from one another by rotation about an axis common to the first and second circles.

The wires thus extend at rest along generatrices of one of the two families of generatrices of a hyperboloid of revolution. When there is inserted into such a socket a plug the diameter of which is greater than the diameter of the cross-section at the throat of the hyperboloid but smaller than the inner diameter of that of the two rings through which the plug is inserted, said plug resiliently deforms the wires which are thus made to engage the plug each along a helically curved portion with a gripping force which only depends on the stretching degree of the wires and on the mechanical characteristics thereof. There is thus obtained a good electrical contact between the plug and the socket wires, whereas the amplitude of deformation of the wires cannot exceed the limit of permanent deformation thereof.

Sockets of this type have been disclosed in U.S. Pat. No. 3,107,966. The sockets disclosed in this prior specification are mainly characterized in that the two rings of each socket are rigidly fixed with respect to each other through a non-deformable cylindrical solid-wall sleeve over both end portions of which the rings are driven in order to wedge the wire ends therebetween.

An object of this invention is to decrease the amount of metallic material which is needed for manufacturing the sockets of the above type and/or, for some applications, to replace in part the metallic material by a moulded plastic material. Another object of this invention is to decrease the volume of metallic material in such a socket as well as to minimize therein the metallic areas having to be provided with a protective covering and consequently to decrease the cost price of said sockets.

With these objects in view, there is provided according to the present invention an electric socket for plug and socket connectors, comprising a plurality of resilient conducting wires each of which is stretched between first and second points located respectively on first and second circles, which circles are located respectively on two relatively rigid rings rigidly fixed with respect to each other, so that a radius of the first circle passing through said first point on each wire and a radius of the second circle passing through said second point on the same wire make between themselves an angle of a fixed value different from zero, whereby straight lines along which the respective wires extend at rest may be obtained from one another by rotation about an axis common to the first and second circles, wherein said two rings are rigidly fixed with respect to each other through at least two metallic, relatively rigid distance-pieces circumferentially spaced from each other, which distance-pieces are each fixed symmetrically to said rings while being inclined substantially in the same direction and by about the same angle as the adjacent resilient wires, with respect to said axis.

In this specification, the expression "metallic, relatively rigid distance-pieces" is used to denote distance-pieces which present a permanent shape, being substantially non-resilient.

It is clear that the replacement of the known non-deformable cylindrical solid-wall sleeve by the at least two spaced metallic distance-pieces according to the invention decreases the amount of metallic material which is needed for manufacturing the electric socket. Furthermore such a replacement allows a simplified method of manufacture to be used, which method comprises the steps of making a hollow member with two relatively rigid rings having a common axis of revolution and fixed with respect to each other through at least two metallic, relatively rigid distance-pieces substantially parallel to said axis, said distance-pieces being spaced circumferentially from each other; stretching resilient conducting wires, parallel to this axis, while fixing each wire through both end portions thereof respectively to said rings; and permanently deforming the distance-pieces by rotating one of the rings relatively to the other about said axis in order to incline in the same direction, about the axis, said distance-pieces and wires and consequently to locate said wires along generatrices of one family of generatrices of a hyperboloid of revolution.

By using this method, it is sufficient to distribute the metallic wires along generatrices of a cylinder and to secure their end-portions to the rings (which is much easier than to distribute them along generatrices of one family of generatrices of a hyperboloid of revolution) and then to rotate one of the rings relatively to the other in order to suitably position the wires and distance-pieces in a single step, their positioning being subsequently maintained by the permanent deformation given to the distance-pieces.

It may be noted that, in U.S. Pat. No. 1,833,145 (Wilhelm) dated Nov. 24, 1931 it has already been proposed to make of a single piece of metal two end rings and elongated contact members parallel to an axis common to both rings, and to rotate one of said rings relatively to the other in order to locate these members approximately along the generatrices of one family of generatrices of a hyperboloid of revolution. In the contact socket thus made, the end rings are connected to each other only by the contact members so that said members are never stretched and can engage a conductor or contact plug at one point only (and not along a helically curved portion), with but a slight force. In order to insert a conductor into the socket, it is suggested to grip and twist one of the end rings in such a direction as to open temporarily the throat of the hyperboloid. From this U.S. patent, the socket according to the invention is distinguished by the presence, between the two end rings, of two groups of inclined members, namely the group of metallic resilient contact wires and the group of metallic relatively rigid distance-pieces, in which case said end rings can be made at will either of metal or of insulating plastic material.

Preferred embodiments of the present invention will be hereinafter described with reference to the accompanying drawings, given merely by way of example and in which.

Figure 4:
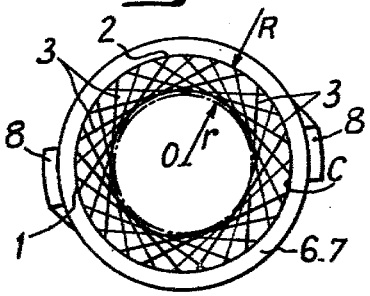
Figure 5:
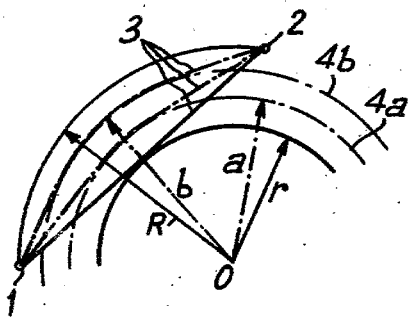

FIG. 5, which shows on a still larger scale a portion of FIG. 4, illustrates the deformation of a contact wire under the effect of two plugs of different diameters.

Figure 3:
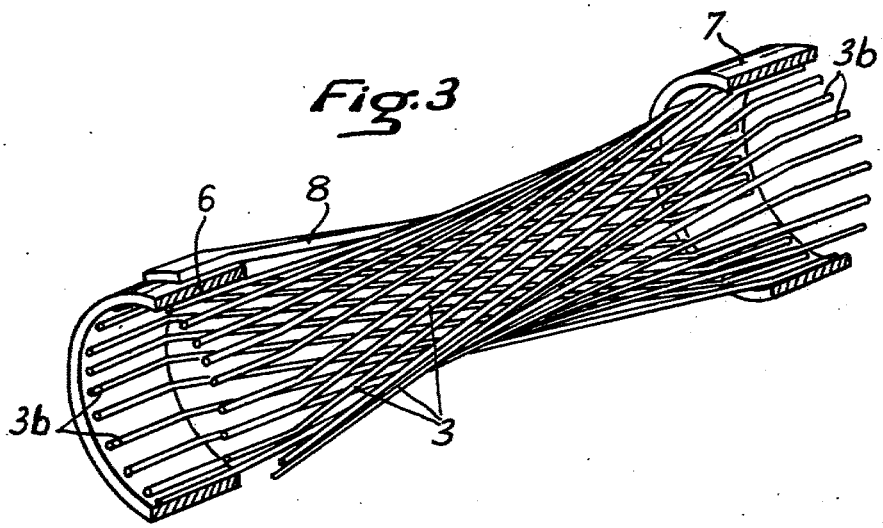
FIGS. 3 and 4 show on a larger scale, respectively in perspective view, partly in section, and in end view, the main elements of the socket of FIG. 2.
Figure 2:
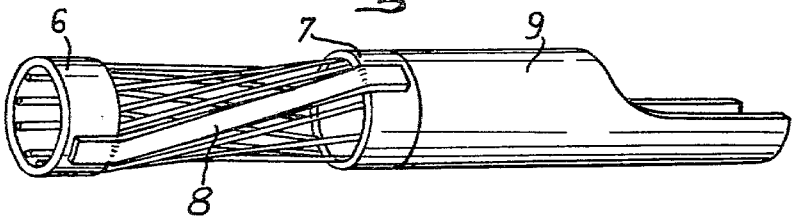
FIG. 2 is a perspective view of a contact socket according to a first embodiment of the present invention.

FIGS. 6 to 9 show four successive steps in the manufacture of the socket of FIGS. 2 to 4.

Figure 10:
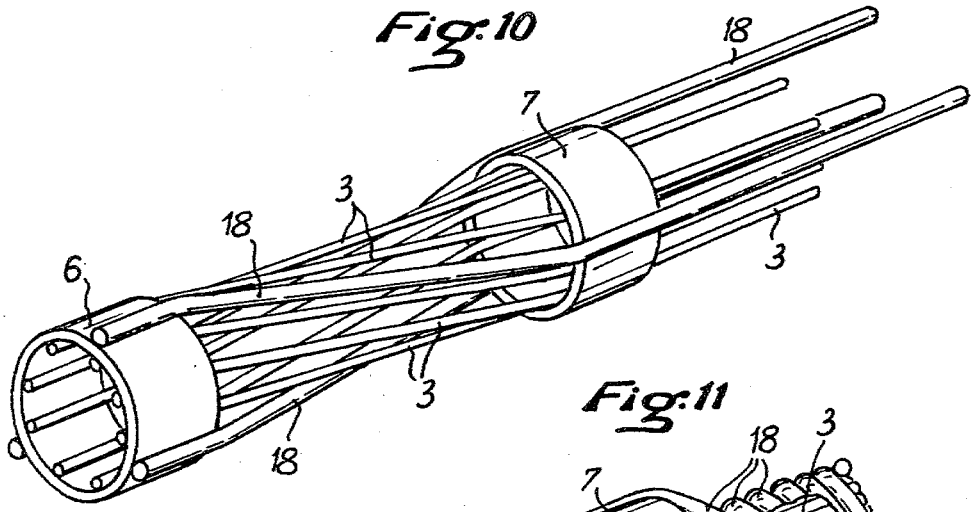

FIG. 10 shows an intermediate step in the manufacture of a contact socket according to a second embodiment of the present invention.

Figure 11:
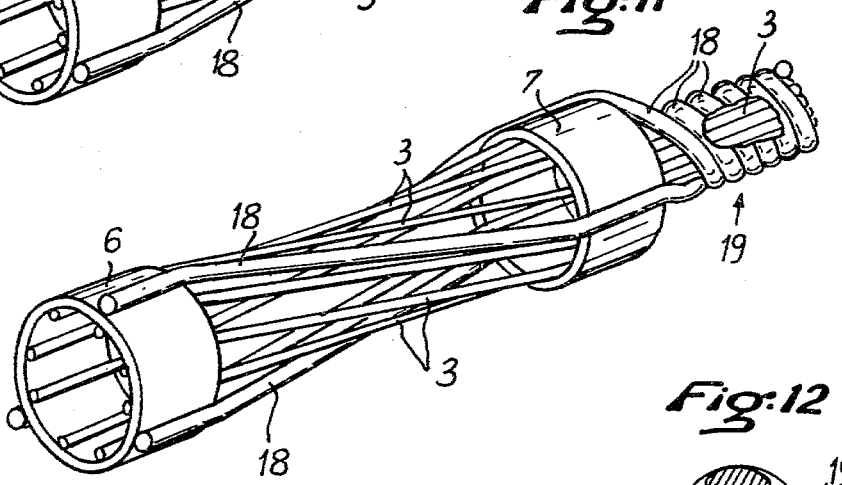

FIG. 11 is a perspective view of the socket according to said second embodiment.

Figure 12:
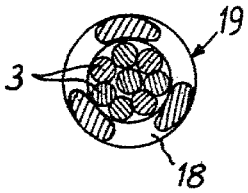

FIG. 12 is a cross-section of the coiled terminal at the end of the contact socket of FIG. 11.

Figure 13:
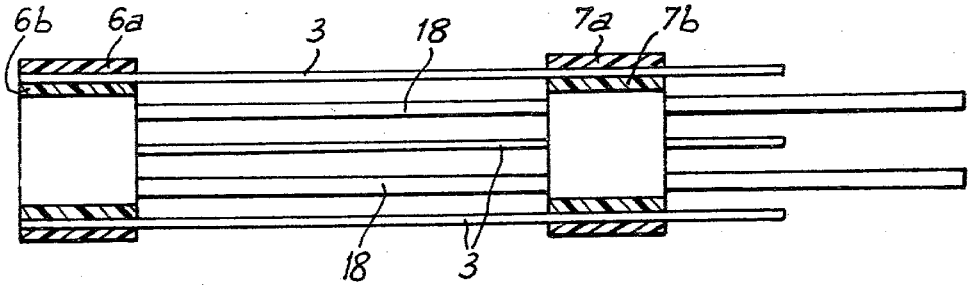

FIG. 13 is an axial section of a contact socket according to a third embodiment of the present invention.

Figure 1:
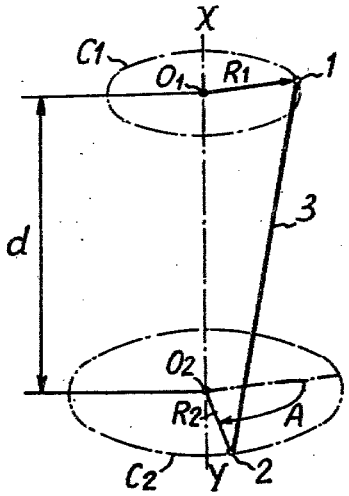
FIG. 1 is a diagrammatical view illustrating the geometrical concept on which the invention is based.

Before disclosing the preferred embodiments of the invention, it seems useful to recall, with reference to FIGS. 1, 4 and 5, the main features of contact sockets according to the above U.S. Pat. No. 3,107,966. As shown first in FIG. 1, the socket includes inwardly a number of contact wires 3 each of which is stretched between two points 1 and 2 located respectively on two circles $C_1$ and $C_2$. The centers of these circles are denoted $O_1$ and $O_2$ respectively and their radii are denoted $R_1$ and $R_2$ respectively. Centers $O_1$ and $O_2$ are located on an axis XY at right angles to the parallel planes of circles $C_1$ and $C_2$, which planes are at a fixed distance d from each other. Circles $C_1$ and $C_2$ are relatively fixed and cannot rotate with respect to each other. The radius $R_2$ of circle $C_2$ passing through point 2 makes with the projection, on the plane of said circle $C_2$, of the radius $R_1$ of circle $C_1$ passing through point 1 a fixed angle A (A being different from zero) and the straight lines along which the respective wires are located may be obtained from one another by rotation about axis XY.

In other words, the wires 3 extend along those portions of generatices of one of the two families of generatrices of a hyperboloid of revolution about axis XY, which are located between the planes of circles $C_1$ and $C_2$.

In FIG. 1, it has been supposed that radii $R_1$ and $R_2$ are different from each other ($R_2$ being greater than $R_1$) but, as a rule, these radii have a same value which is designated by R in FIGS. 4 and 5, in which case centers $O_1$ and $O_2$ are both designated by O and circles $C_1$ and $C_2$ by C.

On FIG. 1 a single wire has been shown at 3 but it appears in particular from FIGS. 2, 3 and 4 that a plurality of wires 3 at rest, which are then rectilinear, form in the middle portion of the socket a throat or passage of minimal radius (radius r in FIGS. 4 and 5) which is smaller than each of the insertion radii $R_1$, $R_2$ or R.

It will be understood that such a socket can accommodate a plug or pin of any radius ranging from the greatest insertion radius $R_2$ or the common radius R to the minimal radius r as above defined. On FIG. 5, there has been shown the position of a wire 3 respectively in the state of rest (solid lines) and (in dot-and-dash lines) after insertion of plugs 4*a* and 4*b* the cross-sections of which have respectively radii a and b between R and r. In the two latter cases one can see that wire 3 is resiliently expanded between points 1 and 2 and includes two rectilinear portions connected together by a helically curved portion along which a contact is obtained between said wire 3 and plug 4*a* or 4*b*.

Thus the contact wires 3 work in the most favorable manner to ensure an optimal electrical contact between the plug and the body of the socket.

According to the above U.S. Pat. No. 3,107,966 circles $C_1$ and $C_2$ are located respectively on the inner surfaces of two relatively rigid rings 6 and 7 which are fixed with respect to each other through a cylindrical solid-wall sleeve.

According to the present invention, the relatively rigid rings 6 and 7 are rigidly fixed with respect to each other through two metallic, relatively rigid distance-pieces 8 circumferentially spaced from each other. Distance-pieces 8 are each fixed symmetrically to said rings 6 and 7 (for instance at the outer surface of the latter, as shown in FIGS. 2 to 4 and 6 to 9) and are inclined substantially in the same direction and by about the same angle as the adjacent resilient wires 3, with respect to the socket axis XY, as shown in particular in FIG. 2.

Figure 6:
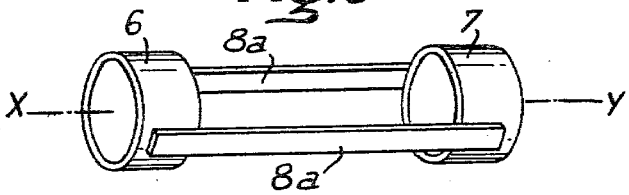
Figure 7:
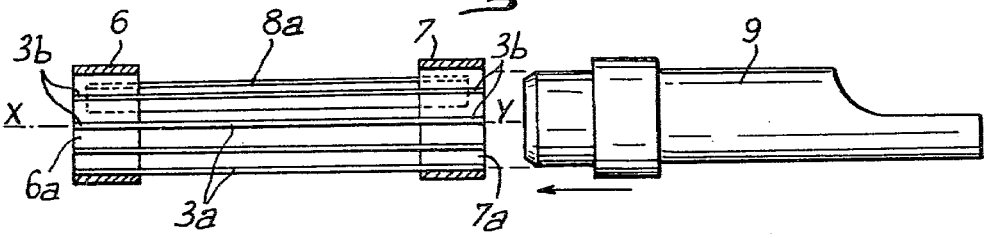
Figure 8:
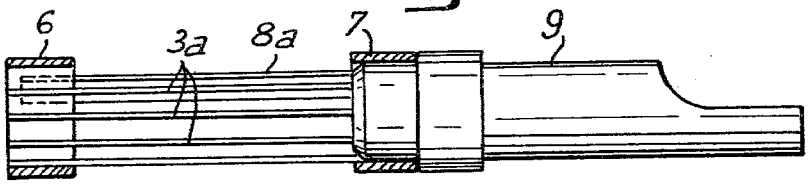
Figure 9:
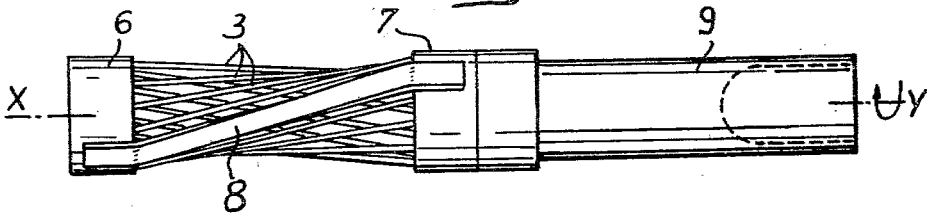

In order to manufacture such a socket, a method is used as illustrated in FIGS. 6 to 9. As shown in FIG. 6, a relatively rigid, hollow member is first made of two rings 6 and 7, having a common axis of revolution XY, and of two rectilinear metallic distance-pieces 8*a*, parallel to axis XY. These distance-pieces are spaced circumferentially from each other and thus occupy together a portion only of the outer periphery of rings 6 and 7. Then, as shown in FIG. 7, resilient conducting wires 3*a* (the cross-section of each of which is circular, polygonal or the like) are stretched parallel to axis XY, each wire 3*a* being secured through both end portions 3*b* thereof at or near the inner surfaces 6*a* and 7*a* of said rings 6 or 7. As shown in FIG. 9, distance-pieces 8*a* are then deformed permanently by rotating rings 6, 7 with respect to each other through angle A about axis XY in order to incline in the same direction about said axis distance-pieces 8*a* and wires 3*a* (designated respectively by 8 and 3 after deformation), along generatrices of one family of generatrices of a hyperboloid of revolution.

In an intermediate step illustrated in FIGS. 7 and 8, one may insert, inside ring 7, a metallic sleeve 9 for electrically connecting metallic wires 3 to an electric power source.

While being rotated relatively to each other, rings 6 and 7 undergo an axial movement which brings them slightly nearer together. If the bending of distance-pieces 8*a*, 8 is ascertained to be sufficiently important during this rotation for unduly unstretching wires 3, it is possible, in order to rotate rings 6 and 7 with respect to each other, to have then caught by rotatable jaws held, parallel to axis XY, so as to prevent at least in part such an axial movement.

Anyway, the mechanical resistance to the deformation opposed by the inclined distance-pieces 8 is sufficient so that the insertion of a plug such as 4*a* or 4*b* (FIG. 5) inside the socket does not vary at all the inclination of distance-pieces 8 to axis XY.

If rings 6 and 7 are made of mouldable insulating material, wires 3 can be entirely embedded in ring 6, at that side remote from connecting sleeve 9. The wire end portions 3*b* are thus protected during the insertion of the plug. At the same side as sleeve 9, wires 3 must not be entirely embedded in ring 7 of insulating material, so that the continuity of an electric circuit may be ensured between wires 3 and sleeve 9.

If rings 6 and 7 are both metallic, the wire end portions 3*b* can be secured by electric welding to the inner surface 6*a*, 7*a* of said rings.

As set forth above with reference to FIG. 1, rings 6 and 7 can have inner diameters different from each other. If that ring 6 through which the plug shall be inserted has the smallest inner diameter, the throat (or area having the smallest inner radius r) of the wire assembly is nearer to said ring 6 than to the other, which permits of shortening the length needed for inserting the plug. When the inner diameters of the two rings 6 and 7 are very slightly different from each other, sleeve 9 may be force fitted on the larger inner diameter ring 7.

In the final socket, rings 6 and 7 and distance-pieces 8 can be wholly exposed, as shown particularly in FIG. 2. It is also possible to coat them with an insulating sheath in order to protect them against accidental connections.

There has been supposed hereinbefore that distance-pieces 8 (after permanent deformation) and consequently 8*a* (before deformation) were secured to rings 6 and 7, notably at the outer surface thereof; this securing can be made by welding or soldering when rings 6 and 7 are metallic or by moulding the rings 6 and 7 over the end portions of distance-pieces 8 when said rings are made of plastic material. According to a variation, distance-pieces 8, 8*a* can also be made integral with rings 6 and 7 by milling a tube, which has the advantage of decreasing the radial dimensions of the socket.

According to the second embodiment illustrated in FIGS. 10 and 11 where rings 6 and 7 and wires 3 are arranged substantially as in the preceding embodiment, the distance-pieces may be made of non-resilient metallic wires 18, permanently deformable and made for example of annealed brass. It is then possible to extend the non-resilient distance-wires 18 as well as the resilient contact wires 3 beyond ring 7, as shown in FIG. 10. Preferably the length by which wires 18 project beyond ring 7 is greater than the length by which wires 3 project beyond said ring. This permits of coiling or twisting wires 18 about resilient wires 3 in order to make a coiled terminal 19 (FIGS. 11 and 12) which will be thereafter connected directly to an electric power source, instead of sleeve 9 of FIGS. 2 and 7 to 9. In this coiled terminal 19, wires 18 are coiled with tight turns about the end portions of resilient wires 3. These end portions, which are rectilinear and parallel to the socket axis, are pressed together as shown in FIG. 12.

The cross-sectional area of wires 18 is substantially greater than that of resilient wires 3 so that, during the insertion of the plug (from left to right in FIG. 11), the position of wires 18 undergoes no variation. The number of wires 18 and their cross-sectional area depend on the number of resilient wires 3 used in the socket.

Lastly, according to the embodiment of FIG. 13, rings 6 and 7 are each replaced by two concentric rings 6*a*, 6*b* or 7*a*, 7*b*, made of moulded plastic material, which interlock resilient wires 3 and distance-wires 18, the whole being subsequently subjected to an ultrasound welding process. The contact between the plug and the socket elastic wire 3 is made as in the preceding embodiments. As for the socket, it is electrically connected to external circuits through a coiled terminal similar to that designated by 19 in FIGS. 11 and 12. Care is taken in order that the distance-wires 18 lie in a position sufficiently offset outwardly in the radial direction, relatively to resilient wires 3, so that any plug inserted into the socket does not engage the distance-wires 18 but the resilient wires 3, whereby the latter can be freely deformed by engagement with the plug.

What I claim is:

1. An electric socket for plug and socket connectors, comprising a plurality of resilient conducting wires each of which is stretched between first and second points located respectively on first and second circles, which circles are located respectively on two relatively rigid rings rigidly fixed with respect to each other, so that a radius of the first circle passing through said first point on each wire and a radius of the second circle passing through said second point on the same wire make between themselves an angle of a fixed value different from zero, whereby straight lines along which the respective wires extend at rest may be obtained from one another by rotation about an axis common to the first and second circles, wherein said two rings are rigidly fixed with respect to each other through at least two metallic, relatively rigid distance-pieces circumferentially spaced from each other, which distance-pieces are each fixed symmetrically to said rings while being inclined substantially in the same direction and by about the same angle as the adjacent resilient wires, with respect to said axis.

2. A socket as claimed in claim 1, in which said distance-pieces are made of non-resilient metallic wires, permanently deformed and extending beyond one of said rings so as to be coiled about extensions of said resilient contact wires and thus to form a coiled terminal.

3. A method of manufacturing an electrical connector socket for plug and socket connectors, comprising a plurality of resilient conducting wires each of which is stretched between first and second points located respectively on first and second circles, which circles are located respectively on two relatively rigid rings rigidly fixed with respect to each other, so that a radius of the first circle passing through said first point on each wire and a radius of the second circle passing through said second point on the same wire make between themselves an angle of a fixed value different from zero, whereby straight lines along which the respective wires extend at rest may be obtained from one another by rotation about an axis common to the first and second circles, said method comprising the steps of making a hollow member with two relatively rigid rings having a common axis of revolution and fixed with respect to each other through at least two metallic, relatively rigid distance-pieces substantially parallel to said axis, said distance-pieces being spaced circumferentially from each other; stretching resilient conducting wires, parallel to this axis, while fixing each wire through both end portions thereof respectively to said rings; and permanently deforming the distance-pieces by rotating one of the rings relatively to the other about said axis in order to incline in the same direction, about the axis, said distance-pieces and wires and consequently to locate said wires along generatrices of one family of generatrices of a hyperboloid of revolution.

* * * * *